United States Patent [19]

Sliger

[11] Patent Number: 4,872,215

[45] Date of Patent: Oct. 10, 1989

[54] CHEST PROTECTOR

[76] Inventor: Willamena Sliger, P.O. Box 52, Idamay, W. Va. 26576

[21] Appl. No.: 158,857

[22] Filed: Feb. 22, 1988

[51] Int. Cl.[4] ..... A41D 13/00

[52] U.S. Cl. ..... 2/2; 2/92; 2/102

[58] Field of Search ..... 2/92, 2, 102

[56] References Cited

U.S. PATENT DOCUMENTS

| | | | |
|---|---|---|---|
| 288,857 | 11/1883 | Purcell | 2/92 |
| 965,487 | 7/1910 | Scott . | |
| 1,250,693 | 12/1917 | Stanger . | |
| 1,489,048 | 4/1924 | Whitley | 2/92 |
| 1,657,866 | 1/1928 | Mooney . | |
| 1,721,739 | 7/1929 | Kennedy . | |
| 2,338,535 | 1/1944 | Pfleumer | 9/20 |
| 2,468,841 | 5/1949 | Siegel | 2/51 |
| 3,162,861 | 12/1964 | Gustafson | 2/2 |
| 3,921,222 | 11/1975 | Hollman | 2/2 |
| 3,945,041 | 3/1976 | Rhee | 2/2 |
| 3,995,320 | 12/1976 | Zafuto | 2/2 |
| 4,100,620 | 7/1978 | Pecoraro | 2/2 |
| 4,578,821 | 4/1986 | Zufle | 2/2.5 |
| 4,602,385 | 7/1986 | Warren | 2/2 |

FOREIGN PATENT DOCUMENTS

| | | | |
|---|---|---|---|
| 1131852 | 9/1982 | Canada | 2/92 |

*Primary Examiner*—Werner H. Schroeder
*Assistant Examiner*—D. Biefeld
*Attorney, Agent, or Firm*—Buchanan Ingersoll; Michael L. Dever

[57] ABSTRACT

A protector for use in sporting activities which is sized to cover the chest and abdomen of its wearer is provided with an outer layer formed of a light-weight leather or leather-like material, an inner layer formed of batting, and closed-cell foam pads provided intermediate the inner and outer layers. Optionally, a lightweight breathable material may be placed alongside the batting. The foam pads are sized and positioned to cover selected vulnerable portions of the chest and abdomen region from damage resulting from a direct impact thereto. The use of foam pads instead of a foam layer throughout the protector maintains the maneuverability of the protector without sacrificing an appreciable loss of protection to the wearer.

7 Claims, 1 Drawing Sheet

CHEST PROTECTOR

BACKGROUND OF THE INVENTION

1. Field of the Invention

The present invention relates to body protectors and more particularly to those protectors adapted to protect the chest area during sporting activity.

2. Description of the Prior Art

Numerous styles and types of protectors have been used to prevent injury to any of the vulnerable organs of the body from heavy physical conduct, such as that which occurs during sparring, wrestling, or martial arts activity. The general location of these organs between the waist and chest have led to the development of protective jackets to guard against injury to the ribs, kidneys, solar plexus and lower stomach. Ideally, such a protective jacket would cushion a blow directed thereagainst, would be as lightweight as possible, would not retain body heat, and would not hinder the maneuverability of the wearer.

Perhaps the most common form of chest protectors are of an inflatable type in which pressurized air is used to inflate a protective jacket. Use of pressurized gas requires the use of a compressor or motorized pump to inflate the jacket. This additional equipment add significantly to the cost of using such a jacket. Futhermore, because a significant quantity of pressurized air is used to inflate the protective jackets, such jackets tend to be extremely bulky. This prevents the use of such jackets in sporting events, such as karate or other martial arts, where maneuverability is required.

SUMMARY OF THE INVENTION

In accordance with the present invention there is provided a chest protector which prevents injury to the vulnerable chest area and allows for maneuverability. The chest protector extends from the waist up to the chest and is designed to cushion a blow directed thereagainst by the use of layers of various lightweight padding materials.

The outer portion of the chest protector is formed from a layer of a leather-like material. An inner portion of the chest protector is formed of batting. A lightweight breathable material is provided immediately inside the batting. A final layer of a closed call foam is arranged in pieces directly over the most vulnerable organs of the body.

In accordance with a preferred embodiment of the present invention, the foam material is placed within the front portion of the chest protector to protect the ribs, the breast, the solar plexus and the lower stomach. Additionally, the foam material is provided along each side of the chest protector to protect the kidneys. Finally, the foam material is provided along both sides of the back of the chest protector to protect against injury to the kidneys and the vertebrae.

DESCRIPTION OF THE PREFERRED EMBODIMENTS

Figure 1:
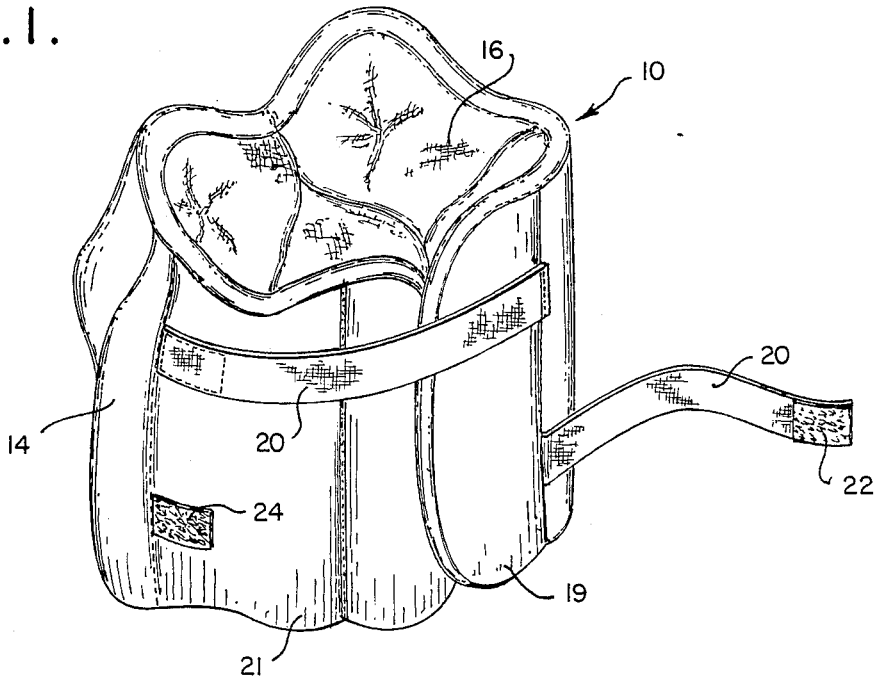
FIG. 1 is an isometric view of the chest protector of a preferred chest protector according to the present invention.
Figure 2:
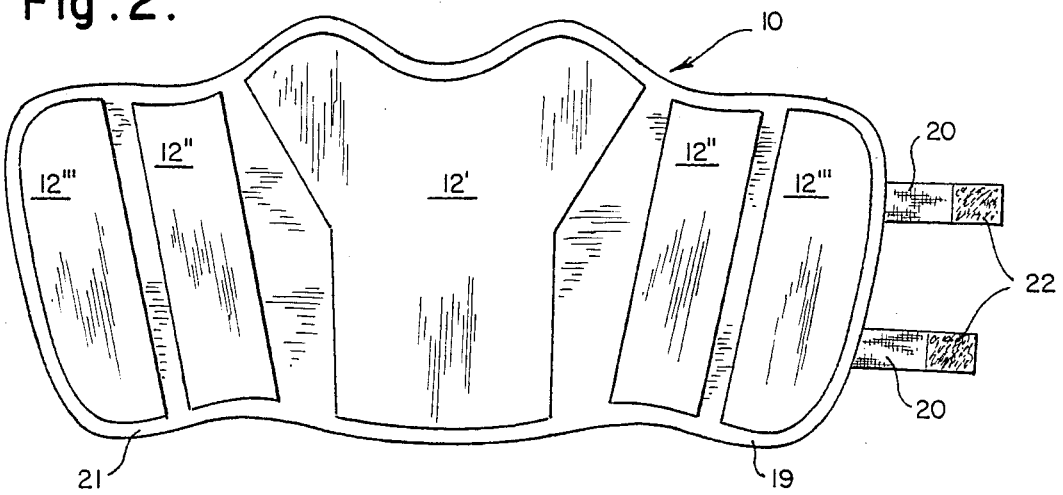
FIG. 2 is a longitudinal sectional view of FIG. 1 showing a means of attaching the chest protector.
Figure 3:
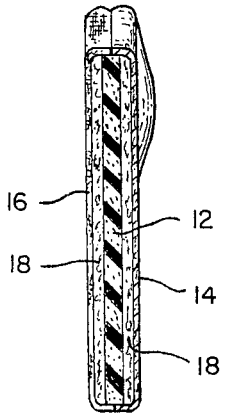
FIG. 3 is a transverse view of the chest protector of FIG. 1.

As shown in FIGS. 1 through 3, chest protector 10 is designed to wrap around the chest and abdomen of a user to provide protection to the vital organs located thereunder. The main protection offered by protector 10 is a series of closed-cell foam pads 12 provided at selected locations throughout the protector. As particularly shown in FIG. 2, foam pads 12 are sized and positioned to cover the front of the protector, both sides of the protector and both back portions of the protector.

In addition to closed-cell foam pad 12, chest protector 10 further includes a layer of leather or leather-like material 14 and a layer of batting 18 provided at either side of foam pad 12. The chest protector 10 is worn by the user such that leather layer 14 is on the outside of the protector 10 and batting 18 is on the inside. Optionally, a lightweight breathable material 16 may be placed alongside the batting 18.

To secure chest protector 10 to the user, securing means are provided. Preferably, elastic or other suitable straps 20 are attached to one end 19 of protector 10. Attachment means are used to secure strap 20 to end 21 of protector 10. I prefer to use VELCRO brand hook-and-loop type fastener provided on the strap 20 and end 21 of the protector as shown at 22 and 24. When attached to end 21, straps 22 secure protector 10 against falling off or slipping during physical activity.

Chest protector 10 is designed primarily for use during sparring and balances the need for protection from damage during sparring with the desire for maneuverability. I have found that a combination of a leather or leather-like layer 14 formed of a material such as NAUGAHYDE brand material and an underlying lightweight layer 16 can safely dissipate the thrust of a force directed to the chest except those thrusts directed toward a vital organ. Therefore, I have placed the heavier closed-cell foam pads 12 directly over the vital organs. Maneuverability is maintained by placing foam pads 12 around protector 10, excluding those areas where the extra protection is not needed. By using foam pads 12 instead of a foam layer, chest protector 10 protects the wearer from damage to his vital organs while maintaining that degree of maneuverability necessary for the wearer to practice his craft for competition.

I have found that five closed-cell foam pads 12 preferably formed from ENSOLITE brand foam are generally needed to protect the vulnerable body members. A large foam pad 12' is sized and positioned to cover the front portion of the chest protector 10. Foam pad 12' protects the ribs, the breast, the solar plexus and the lower stomach from damage from forceful thrusts directed thereto. Two foam pads 12'' are provided along each side of the chest protector 10. Foam pads 12'' protect the kidneys from thrusts directed thereto. Finally, two foam pads 12''' are provided along both sides of the back of the chest protector 10. Foam pads 12''' protect the kidneys and vertebrae region from injury.

In order to provide chest protector 10 with the ability to withstand heavy sparring use, I prefer to hand sew most of the protector 10. I have found that this provides sufficient durability for chest protector 10.

While I have described certain presently preferred embodiments of my invention, it is to be distinctly understood that the invention is not limited thereto and may be otherwise variously practiced within the scope of the following claims.

I claim:

1. A protector for use in sporting activities sized to cover the chest and abdomen of a user comprising a first protective member, said first protective member comprising an outer layer formed of one of leather or lightweight leather-like material and an inner layer formed of batting, at least two laterally spaced apart pieces of a closed-cell foam provided intermediate said outer layer and said inner layer, each of said pieces of foam sized and positioned to cover a selected different vulnerable portion of the chest and abdomen regions to provide additional protection to those selected different vulnerable portions, and means to secure the protector around the chest and abdomen.

2. The protector of claim 1 further comprising a layer of lightweight breathable material provided immediately beside the batting.

3. The protector of claim 1 wherein one of said pieces of closed-cell foam is sized and positioned to cover the front chest region.

4. The protector of claim 1 wherein one of said pieces of closed-cell foam is sized and positioned to cover the sides of the abdomen outside the kidneys.

5. The protector of claim 1 wherein one of said pieces of closed-cell foam is sized and positioned to cover the back of the user along either side of the backbone.

6. The protector of claim 1 wherein said means to secure the protector comprises at least one elastic strap having one end secured to a first end portion of said protector and means for attaching a second end of said strap to a second end portion of said protector.

7. The protector of claim 6 wherein said attachment means comprises a hook-and-loop type fastener provided on said second end of said strap and said second end portion of said protector.

* * * * *